US008662477B2

(12) United States Patent
Bacon

(10) Patent No.: US 8,662,477 B2
(45) Date of Patent: Mar. 4, 2014

(54) BELT-DRIVEN TRANSPORTATION SYSTEM

(75) Inventor: Todd J. Bacon, Northville, MI (US)

(73) Assignee: Herkules Equipment Corporation, Walled Lake, MI (US)

( * ) Notice: Subject to any disclaimer, the term of this patent is extended or adjusted under 35 U.S.C. 154(b) by 1079 days.

(21) Appl. No.: 12/639,632

(22) Filed: Dec. 16, 2009

(65) Prior Publication Data

US 2011/0139548 A1 Jun. 16, 2011

(51) Int. Cl.

| | |
|---|---|
| ***B66F 3/22*** | (2006.01) |
| ***B66F 3/00*** | (2006.01) |
| ***B66D 1/36*** | (2006.01) |

(52) U.S. Cl.

USPC ..... 254/338; 254/122; 254/126; 254/124

(58) Field of Classification Search

USPC ..... 254/122, 126, 124, 338, 4 R; 269/131; 187/269

See application file for complete search history.

(56) References Cited

U.S. PATENT DOCUMENTS

| | | | | |
|---|---|---|---|---|
| 484,038 | A * | 10/1892 | Morgan | 254/399 |
| 1,991,255 | A | 2/1935 | Martin | |
| 3,785,462 | A * | 1/1974 | Coad et al. | 187/262 |
| 3,901,356 | A | 8/1975 | Butler | |
| 4,219,186 | A | 8/1980 | Brewer | |
| 4,427,093 | A | 1/1984 | Wehmeyer et al. | |
| 4,534,544 | A | 8/1985 | Heide | |
| 4,577,821 | A | 3/1986 | Edmo et al. | |
| 4,619,346 | A | 10/1986 | Deguerry | |
| 4,858,482 | A | 8/1989 | Knudsen | |
| 4,872,800 | A | 10/1989 | Gutov et al. | |
| 4,899,987 | A | 2/1990 | Craig | |
| 4,905,496 | A | 3/1990 | Venalainen | |
| 4,921,074 | A | 5/1990 | Ochs | |
| 5,149,242 | A | 9/1992 | Haymore | |
| 5,299,906 | A | 4/1994 | Stone | |
| 5,322,143 | A | 6/1994 | Curran | |
| 5,513,723 | A | 5/1996 | Luebke | |
| 5,636,711 | A | 6/1997 | Nussbaum | |
| 5,695,173 | A | 12/1997 | Ochoa et al. | |
| 5,722,513 | A | 3/1998 | Rowan et al. | |

(Continued)

FOREIGN PATENT DOCUMENTS

EP 0501254 A2 2/1992

OTHER PUBLICATIONS

English language translation of Abstract for European Patent Application No. 0501254A2, filed Feb. 28, 1991.

*Primary Examiner* — Lee D Wilson
*Assistant Examiner* — Seahee Yoon
(74) *Attorney, Agent, or Firm* — Howard & Howard Attorneys PLLC

(57) ABSTRACT

A belt-driven transportation system including a first set of pulleys rotatably attached to a first member and a second set of pulleys rotatably attached to a second member. The first and second members have relative movement to each other. The system further includes a unitary belt that is guided through a path defined by the first and second sets of pulleys with the path substantially lying in a stationary plane, and a plurality of retention rollers. A retention roller is disposed adjacent each pulley, with the belt extending about the pulley and between the pulley and the retention roller. The positioning of the belt substantially on the path is maintained by the plurality of retention rollers, and the first and second members are moved relative to each other with changes in the length of the path.

17 Claims, 13 Drawing Sheets

(56) References Cited

U.S. PATENT DOCUMENTS

| | | | | |
|---|---|---|---|---|
| 5,934,414 | A | 8/1999 | Staczek | |
| 6,092,788 | A | 7/2000 | Simon | |
| 6,257,372 | B1 | 7/2001 | Schirmer | |
| 6,286,629 | B1 | 9/2001 | Saunders | |
| 6,305,499 | B1 | 10/2001 | Jones et al. | |
| 6,371,247 | B1 | 4/2002 | Nedderman, Jr. | |
| 6,464,205 | B2 | 10/2002 | Wanner | |
| 6,537,017 | B2 | 3/2003 | Stone | |
| 6,591,945 | B1 | 7/2003 | Kigawa et al. | |
| 6,601,826 | B1 | 8/2003 | Granata | |
| 6,619,433 | B1 | 9/2003 | Robert et al. | |
| 6,634,462 | B2 | 10/2003 | Byeong-Ho | |
| 6,640,934 | B1 | 11/2003 | Edwards | |
| 6,672,430 | B2 | 1/2004 | Boucher et al. | |
| 6,679,479 | B1 | 1/2004 | Watkins | |
| 6,705,238 | B1 | 3/2004 | Heckert | |
| 6,742,768 | B2 | 6/2004 | Alba | |
| 6,779,635 | B1 | 8/2004 | Anibas | |
| 6,814,188 | B1 | 11/2004 | Heckert | |
| 6,854,715 | B2 | 2/2005 | Hicks et al. | |
| 7,070,167 | B1 | 7/2006 | Bacon et al. | |
| 7,117,977 | B2 | 10/2006 | Abe | |
| 7,213,686 | B2 | 5/2007 | Kaufman | |
| 7,225,901 | B2 | 6/2007 | Mustalahti et al. | |
| 7,331,425 | B2 | 2/2008 | Bukowski et al. | |
| 7,383,923 | B2 | 6/2008 | Patten et al. | |
| 7,413,056 | B2 * | 8/2008 | Gonzi et al. | 187/269 |
| 7,461,722 | B2 | 12/2008 | Kyotani | |
| 7,506,725 | B2 | 3/2009 | Kuo et al. | |
| 2006/0037518 | A1 | 2/2006 | Lopez Alba | |
| 2007/0213154 | A1 * | 9/2007 | Broyan | 474/148 |
| 2011/0139549 | A1 * | 6/2011 | Bacon | 187/269 |

* cited by examiner

BELT-DRIVEN TRANSPORTATION SYSTEM

BACKGROUND OF THE INVENTION

1. Field of the Invention

The present invention relates generally to belt-driven transportation systems, and particularly to such systems configured as lift assemblies and conveyor assemblies.

2. Description of the Related Art

Transportation systems such as lift assemblies are well known for moving items or people between two vertically differing locations. Transportation systems such as conveyor assemblies are well known for moving items or people between two horizontally differing locations. It is also known to move the platform or carriage of these systems through a belt-driven apparatus.

One well-known and useful type of lift assembly is the scissor-type, which moves between a lowered or contracted state, and an elevated or extended state as its load-supporting platform is moved between differing vertical locations. Such lift assemblies are commonly driven through hydraulic cylinders, screw-drive mechanisms or expandable pneumatic bladder arrangements, and some prior types of scissor lift assemblies are belt-driven. These prior lift assemblies, however, often require a substantial amount of power, particularly when moving from their lowermost contracted states, or are difficult to reliably, precisely control.

Further, some prior belt-driven transportation systems can be problematic to install or repair, and sometimes to operate, due to the belt being moved out of its guided position along its designed path over pulleys that it engages. Another problem with some types of belt-driven transportation systems is that they rely on traction between the belt and the pulleys to operate, which can lead to slippage under heavy loading and result in unintentional lift collapse. Additionally, some transportation systems of the types described above, particularly lift assemblies, undesirably require operating space that cannot be easily accommodated or interferes with carrying out the operation to which the system is applied. For example, some prior lift assemblies have platform heights in their fully contracted states that require the load to first be lifted a substantial vertical distance from the level of a floor, on which the base is positioned, to place it on the platform. Thus, it would be preferable to minimize the height of the platform in its fully contracted or lowered state.

A transportation system configured as a lift assembly or conveyor assembly that addresses at least one of the above-mentioned problems is desirable.

SUMMARY OF THE INVENTION

The present invention provides a scissors-type lift assembly including a base and a platform, the lift assembly having elevated and lowered states in which the platform and base are distant and proximate, respectively. The lift assembly further includes a pair of first and second scissor arms each having upper and lower ends respectively coupled to the platform and the base, the pair of scissor arms pivotably connected to each other intermediate their respective upper and lower ends about a central pivot axis. Also provided are a first pulley arrangement that includes at least one first pulley disposed about a first pulley axis, and a second pulley arrangement that includes at least one second pulley disposed about a second pulley axis, the first and second pulley axes disposed in a pulley plane and having lateral movement relative to each other as the lift assembly is moved between its elevated and lowered states, the pulley plane fixed relative to the base. A spool is rotatable about an axis fixed to the base, and a unitary belt is guided through a path defined by the first and second pulleys. The belt has opposed first and second ends, the belt first end engaged with the spool onto which the belt is wound and from which the belt is unwound. The first and second pulley axes have a first lateral distance therebetween in the lift assembly elevated state and a second lateral distance therebetween greater than the first distance in the lift assembly lowered state, and the first and second pulley axes pulled laterally together by the belt as it is wound onto the spool.

The invention further provides a scissors-type lift assembly including a base and a platform, the lift assembly having extended and contracted states with the platform at a relatively greater distance from the base in the extended state than in the contracted state. The lift assembly further includes a pair of first and second elongate arms each having opposite ends and extending between the base and the platform. The first and second arms are pivotably connected together and cross each other substantially at a first angle in the extended state and substantially at a second angle in the contracted state. Also included are a first pulley arrangement including at least one first pulley rotatably disposed about a first pulley axis, and a second pulley arrangement including at least one second pulley rotatably disposed about a second pulley axis, the first and second pulley axes defining a stationary plane in which the first and second pulley axes have relative lateral movement. One of the first and second pulley arrangements is affixed to one of the first and second elongate arms, and the arms are moved between the first and second angles with relative lateral movement of the pulley axes. A spool is rotatable about an axis of rotation fixed relative to the base, and a unitary belt is guided through a path defined by the first and second pulleys, the belt having opposed first and second ends. The belt first end is engaged with the spool onto which the belt is wound and from which the belt is unwound, and the first and second pulley axes are moved laterally in opposite directions relative to each other as the belt is respectively wound onto and unwound from the spool.

The present invention further provides a lift assembly including a base, a platform, and a pair of first and second elongate scissor arms each having a first end coupled to the base and a second end coupled to the platform, the first and second scissor arms pivotably connected to each other at a location between their respective first and second ends. The lift assembly further has a belt and pulley apparatus that includes a unitary belt having opposite first and second ends, a belt spool rotatably attached to the base and having reversible rotation about a spool axis. The belt first end is secured to the spool, and the belt second end is secured to the base. The belt is respectively wound onto and unwound from the spool with reversing rotation of the spool. Also included are a first pulley arrangement having a plurality of first pulleys disposed about a first axis, and a second pulley arrangement having at least one second pulley disposed about a second axis fixed relative to the base. The first and second axes are substantially parallel with each other and laterally movable relative to each other in a stationary plane, with the first axis fixed to one of the first and second scissor arms.

The present invention further includes a belt-driven transportation system including a first set of pulleys rotatably attached to a first member and a second set of pulleys rotatably attached to a second member. The first and second members have relative movement to each other. The system further includes a unitary belt that is guided through a path defined by the first and second sets of pulleys with the path substantially lying in a stationary plane, and a plurality of retention rollers. A retention roller is disposed adjacent each pulley, with the belt extending about the pulley and between the pulley and the retention roller. The positioning of the belt substantially on the path is maintained by the plurality of retention rollers, and the first and second members are moved relative to each other with changes in the length of the path.

There has thus been outlined, rather broadly, certain features of embodiments of the invention in order that the detailed descriptions thereof may be better understood, and in order that the present contribution to the art may be better appreciated. Additional or alternative features of embodiments of the invention are described in further detail below.

In this respect, before explaining embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

To accomplish the above and related objects, the invention may be embodied in the forms illustrated in the accompanying drawings, attention being called to the fact, however, that the drawings are illustrative only, and that changes may be made in the specific constructions illustrated. Moreover, it is to be noted that the accompanying drawings are not necessarily drawn to scale or to the same scale. In particular, the scale of some of the elements of the drawings may be exaggerated to emphasize characteristics of the elements.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 13 is a graph comparing the motor loads of the first and second embodiment scissor lift assemblies (each with single belt drive) as they respectively move from their lowered to their elevated states.

Figure 1:
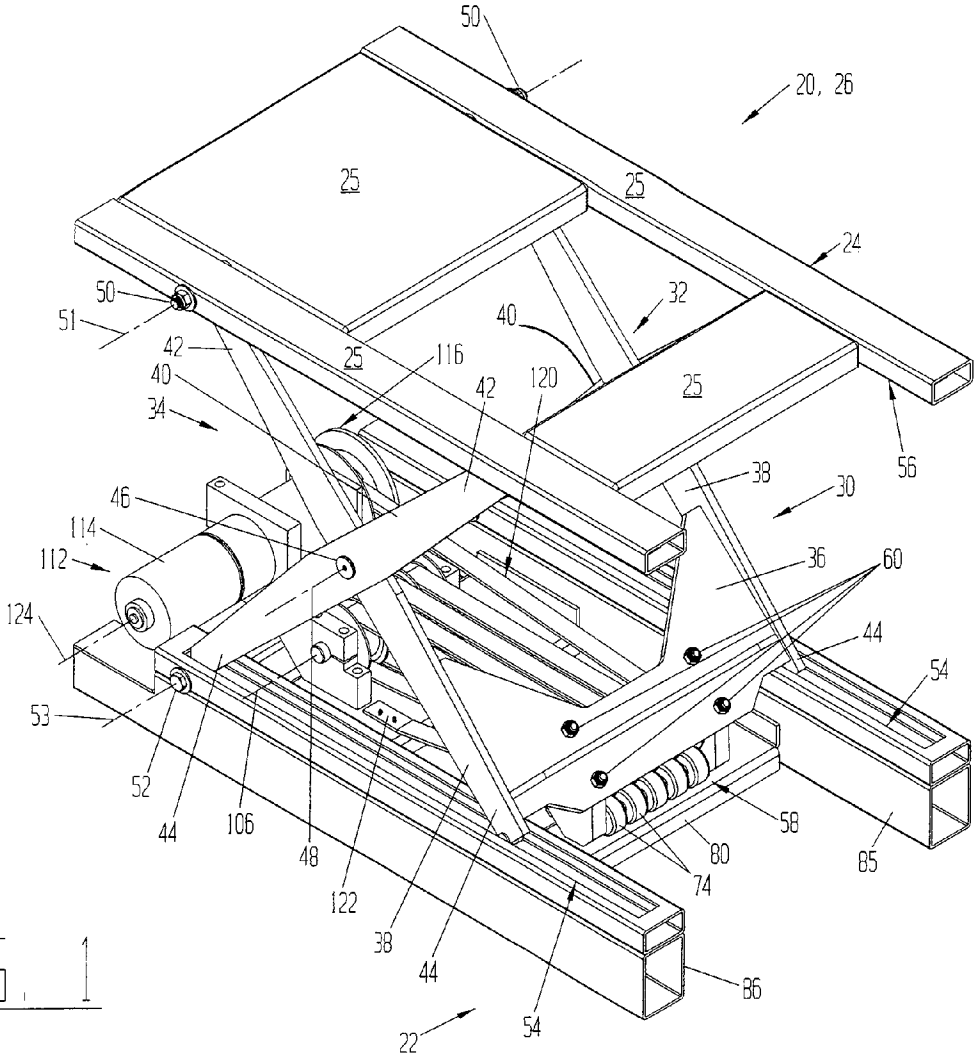
FIG. 1 is a perspective view of a scissor-type lift assembly according to a first embodiment in an elevated state.

While the invention is susceptible to various modifications and alternative forms, specific embodiments thereof are shown by way of example in the drawings and may herein be described in detail. It should be understood, however, that the drawings and detailed description thereto are not intended to limit the invention to the particular forms disclosed, but on the contrary, the intention is to cover all modifications, equivalents and alternatives falling within the spirit and scope of the present invention as defined by the appended claims.

DETAILED DESCRIPTION

Figure 2:
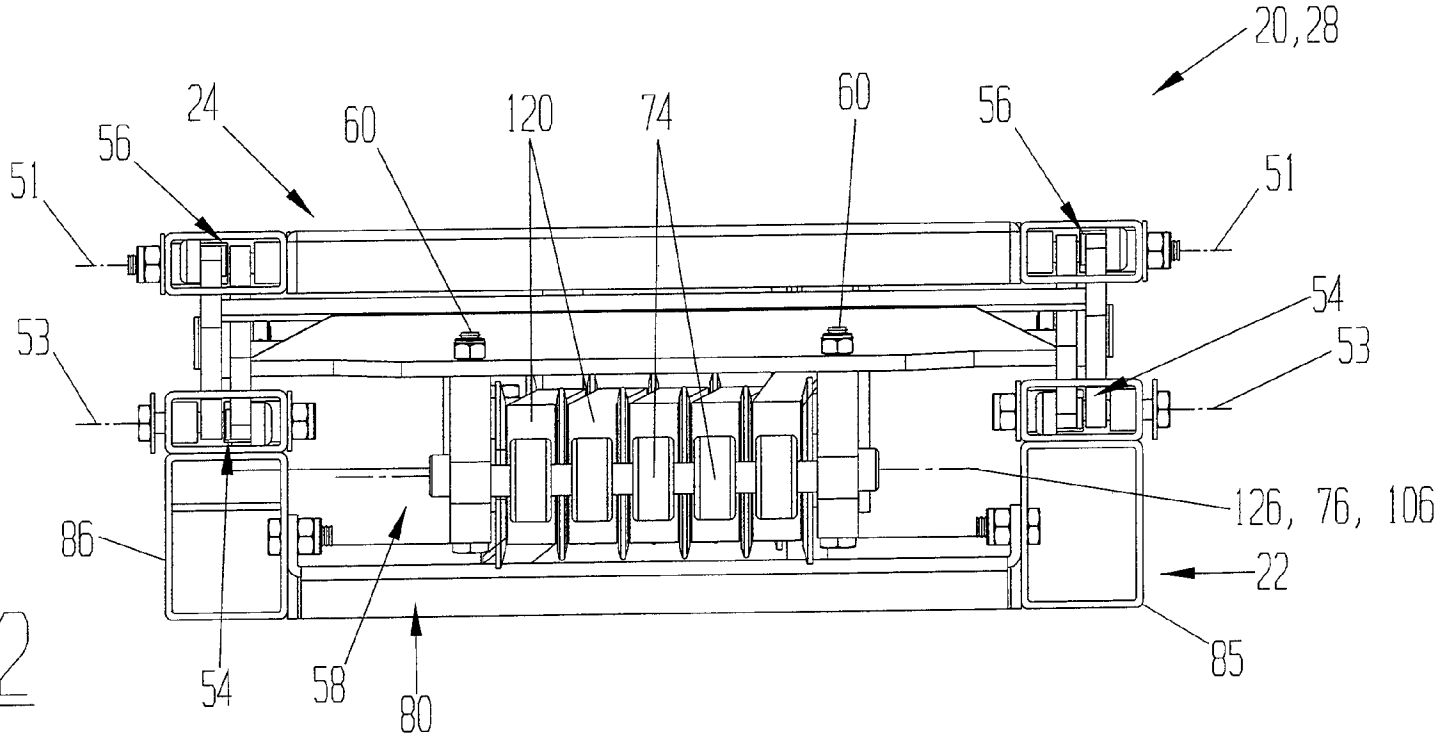
FIG. 2 is a front view of the lift assembly shown in FIG. 1 in a lowered state.
Figure 3:
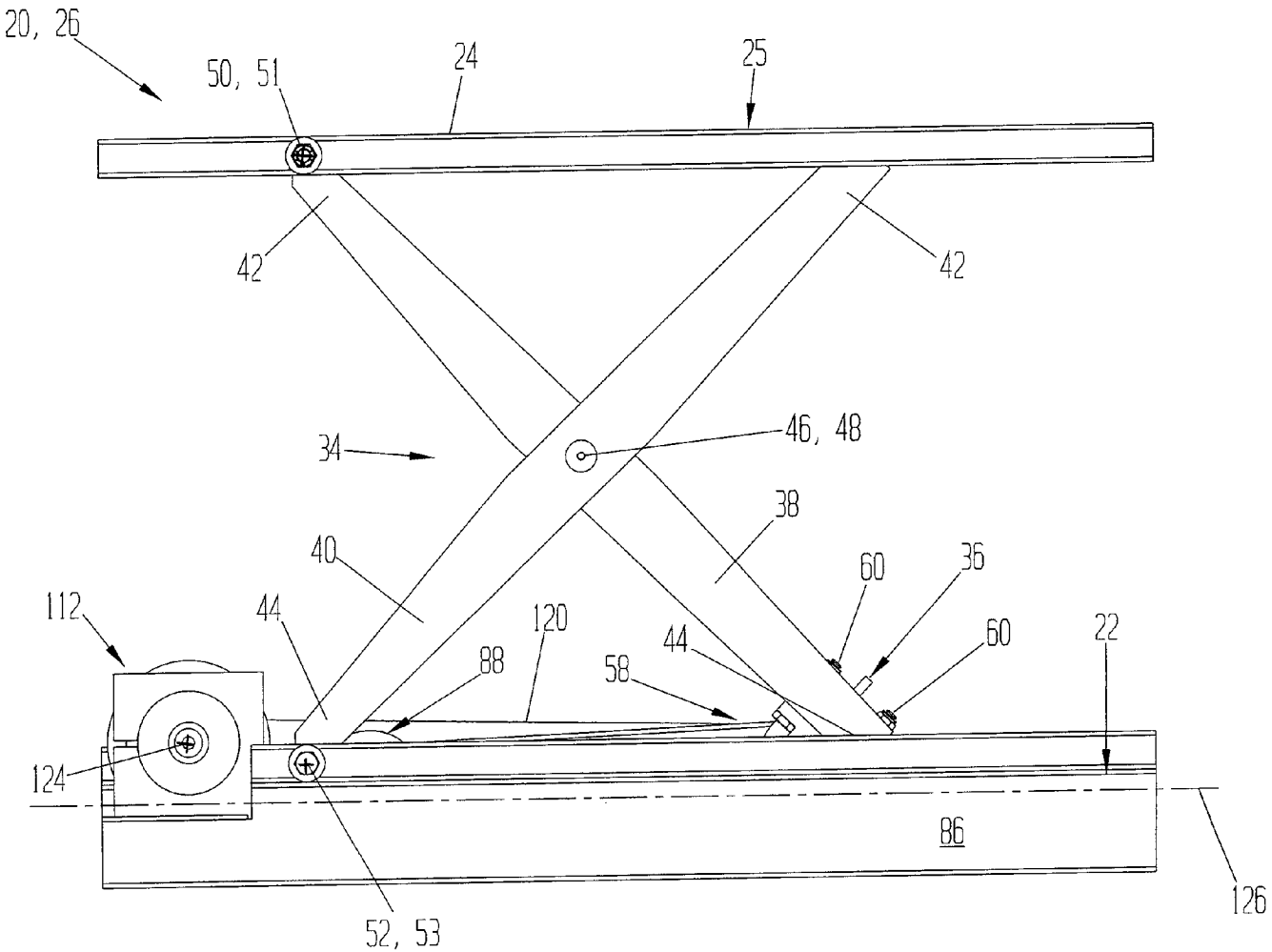
FIG. 3 is a side view of the lift assembly shown in FIG. 1 in an elevated state.
Figure 4:
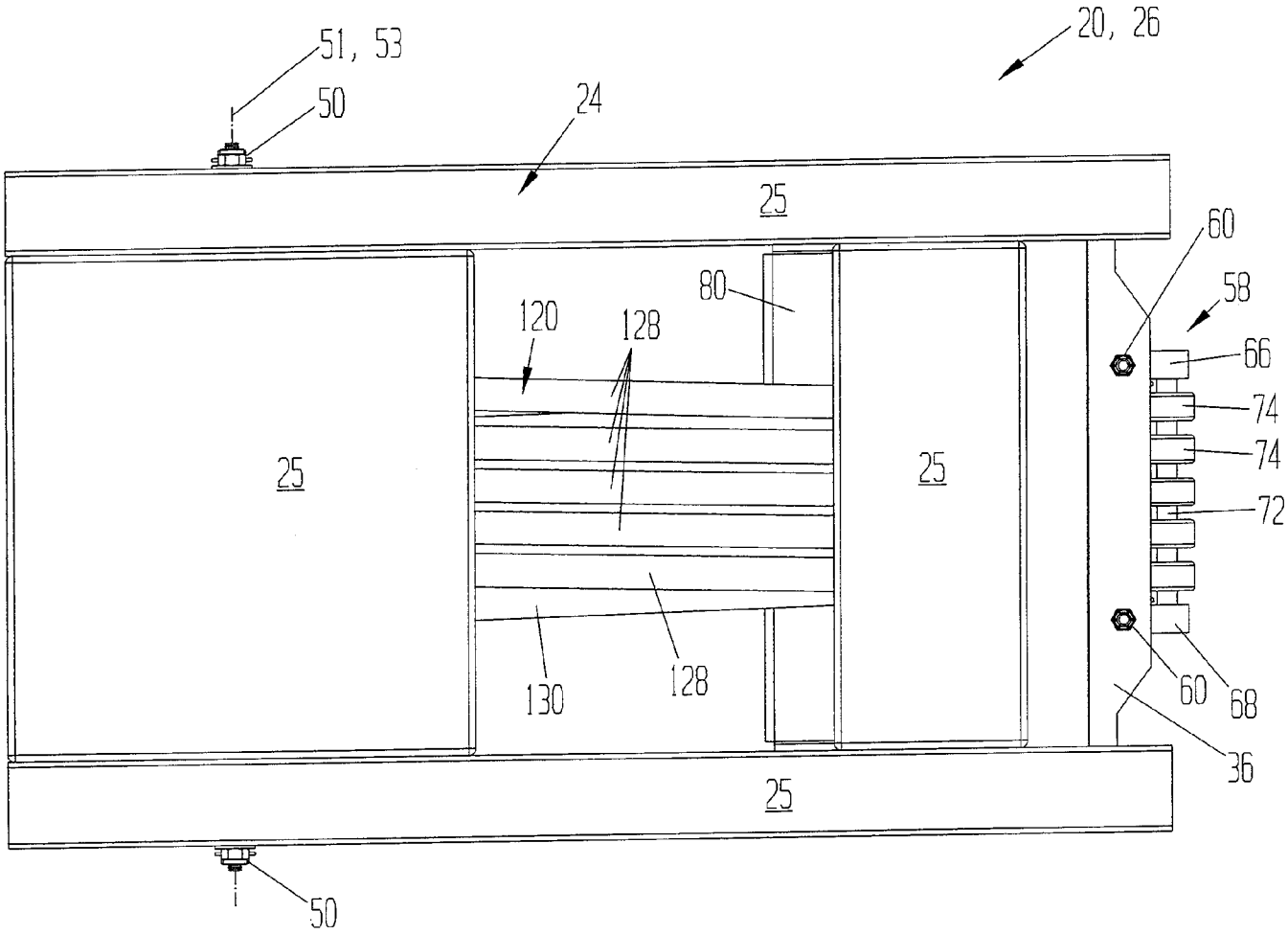
FIG. 4 is a top view of the lift assembly shown in FIG. 1 in a lowered state.
Figure 5:
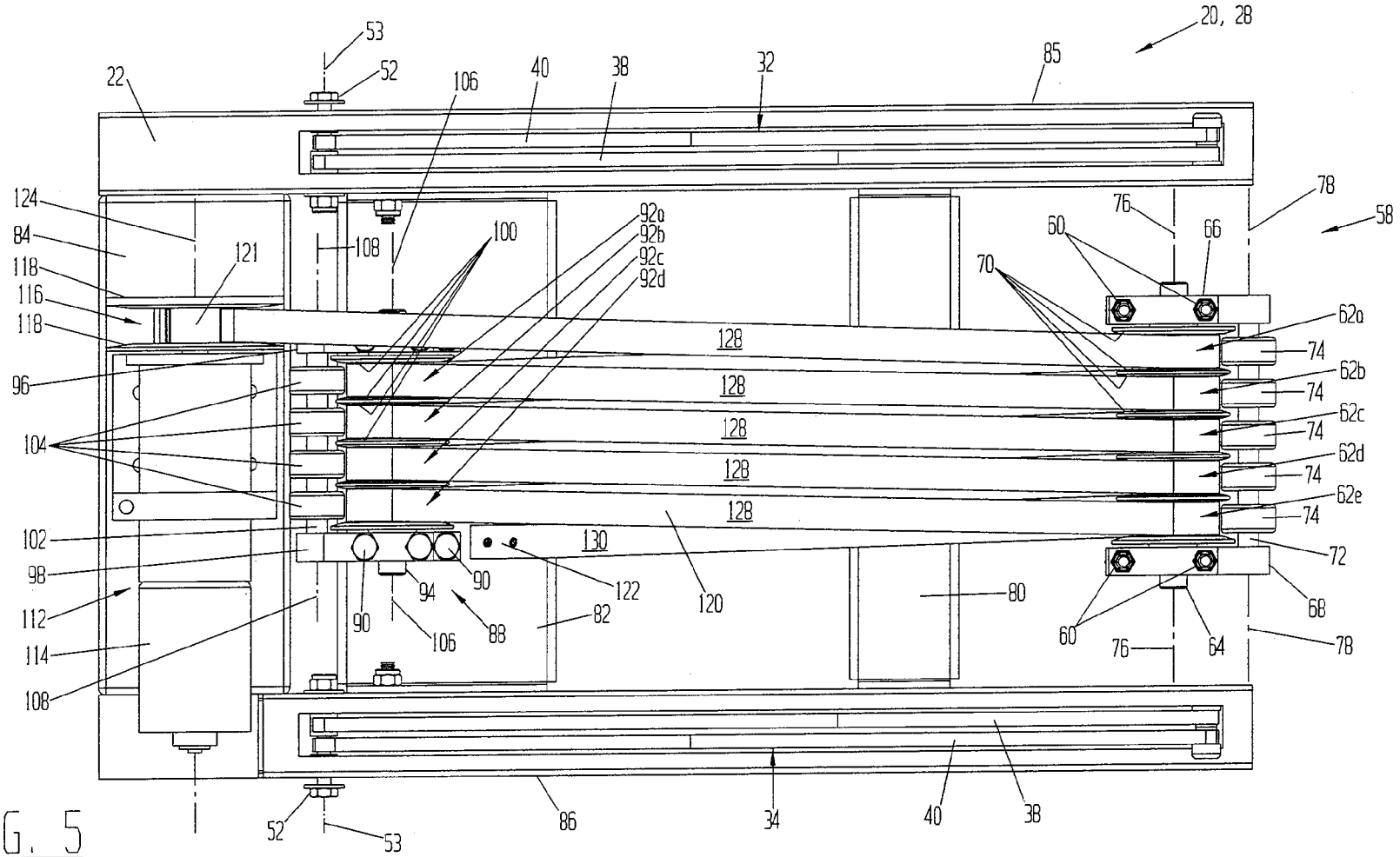
FIG. 5 is a top view of the lift assembly shown in FIG. 1 in a lowered state with its platform removed from view.

Referring FIGS. 1-5 there is show first embodiment scissor-type lift assembly 20 which has a base 22 and a platform 24, each of which may be made of steel. Platform 24 has upwardly facing supporting surfaces 25. Lift assembly 20 has an elevated state 26 in which the platform and base are distant from each other, and a lowered state 28 in which the lift assembly base and platform are proximal to each other. FIGS. 1 and 3 show lift assembly 20 in elevated state 26, and FIGS. 2, 4 and 5 show lift assembly 20 in lowered state 28.

Disposed between and operatively connected to base 22 and platform 24 is scissor arm assembly 30 which includes first pair of scissor arms 32 and second pair of scissor arms 34. Between the first and second pair of scissor arms is brace 36, which extends between first arm 38 of each of the first and second pairs of scissor arms 32, 34. The first and second pairs of scissor arms 32 and 34 each further includes second arm 40. Arms 38, 40 may be made of steel. Upper end 42 of each first and second arm 38, 40 engages platform 24, and lower end 44 of each first and second arm 38, 40 engages base 22. Respective to each pair of scissor arms 32, 34, first and second arms 38, 40 are pivotably connected to each other through a bolted connection 46 about pivot axis 48 of scissor arm assembly 30.

Each first arm 38 has a bolted connection 50 to platform 24, which defines pivot axis 51, and each second arm 40 has a bolted connection 52 to base 22, which defines pivot axis 53. Base 22 includes guide tracks 54 in which lower ends 44 of the first arms 38 are slidably engaged, and platform 24 includes guide tracks 56 in which upper ends 42 of second arms 40 are slidably engaged.

Lift assembly 20 further includes first pulley arrangement 58 which is connected to brace 36 with bolts 60. First pulley arrangement 58 includes a plurality of pulleys 62. Five pulleys 62, identified as pulleys 62*a* through 62*e* in FIG. 5, are independently rotatable about shaft 64, which extends between and is fixed to laterally spaced blocks or support members 66 and 68, into which bolts 60 are threadedly received. Blocks 66, 68 may be made of steel.

Adjacent pulleys 62 may have therebetween a bushing or other friction reducing member (not shown) to facilitate their independent rotation relative to each other about shaft 64. Each of pulleys 62 has opposing flanges 70 between which is defined a belt engaging circumferential pulley surface 330 discussed further below.

First pulley arrangement 58 further includes shaft 72 that is parallel with shaft 64, and about which are disposed independently rotatable retainer rollers 74, one for each of pulleys 62. Shaft 72 also extends between and is fixed to laterally spaced blocks or support members 66 and 68. Thus, pulleys 62 and retainer rollers 74 are respectively rotatable about parallel axes of rotation 76 and 78 respectively defined by shafts 64 and 72. It is thus understood that first pulley arrangement 58 moves relative to base 22 with first scissor arms 38 as lift assembly 20 is moved between its elevated and lowered states 26, 28.

Base 22 includes laterally extending cross braces 80, 82, and 84 which extend between and are fixed to its opposite rails 85, 86. Attached to cross brace 82 is second pulley arrangement 88, which is fixed to base 22 by means of bolts 90. Second pulley arrangement 88 includes a plurality of pulleys 92. Four pulleys 92, identified as pulleys 92*a* through 92*d* in FIG. 5, are independently rotatable about shaft 94, which extends between and is fixed to laterally spaced blocks or support members 96 and 98, into which bolts 90 are threadedly received.

Adjacent pulleys 92 may have therebetween a bushing or other friction reducing member (not shown) to facilitate their independent rotation relative to each other about shaft 94. Each of pulleys 92 has opposing flanges 100 between which is defined a belt engaging circumferential pulley surface 330 discussed further below.

Second pulley arrangement 88 further includes shaft 102 that is parallel with shaft 94, and about which are disposed independently rotatable retainer rollers 104, one for each of pulleys 92. Shaft 102 also extends between and is fixed to laterally spaced blocks or support members 96 and 98. Thus, pulleys 92 and retainer rollers 104 are respectively rotatable about parallel axes of rotation 106 and 108 respectively defined by shafts 94 and 102.

Lift assembly 20 further includes motor drive assembly 112, which includes reversible servo or stepper motor 114, which is in driving, co-axial engagement with spool or pulley 116, which has opposed flanges 118 between which is defined a belt engaging portion. Unitary belt 120 having opposite first and second ends 121, 122 is guided along a path defined by pulleys 62 and 92, and first end 121 of belt 120 is connected to spool 116 such that rotation of the spool about its axis of rotation 124 will either wind belt 120 onto the spool or unwind belt 120 from the spool. Spool axis of rotation 124 is substantially parallel with pulley axes 76 and 106.

A plane 126 is defined by pulley axes 76 and 106, and maintains a substantially horizontal orientation, parallel with platform surfaces 25. As best seen in FIG. 3 plane 126 is disposed within the height defined by base 22. The first and second pulley arrangements 58, 88 move toward and away from each other in plane 126 as lift assembly 20 is moved between its elevated and lowered states 26, 28. Relative to lift assembly 20, plane 126 is stationary.

Figure 12:
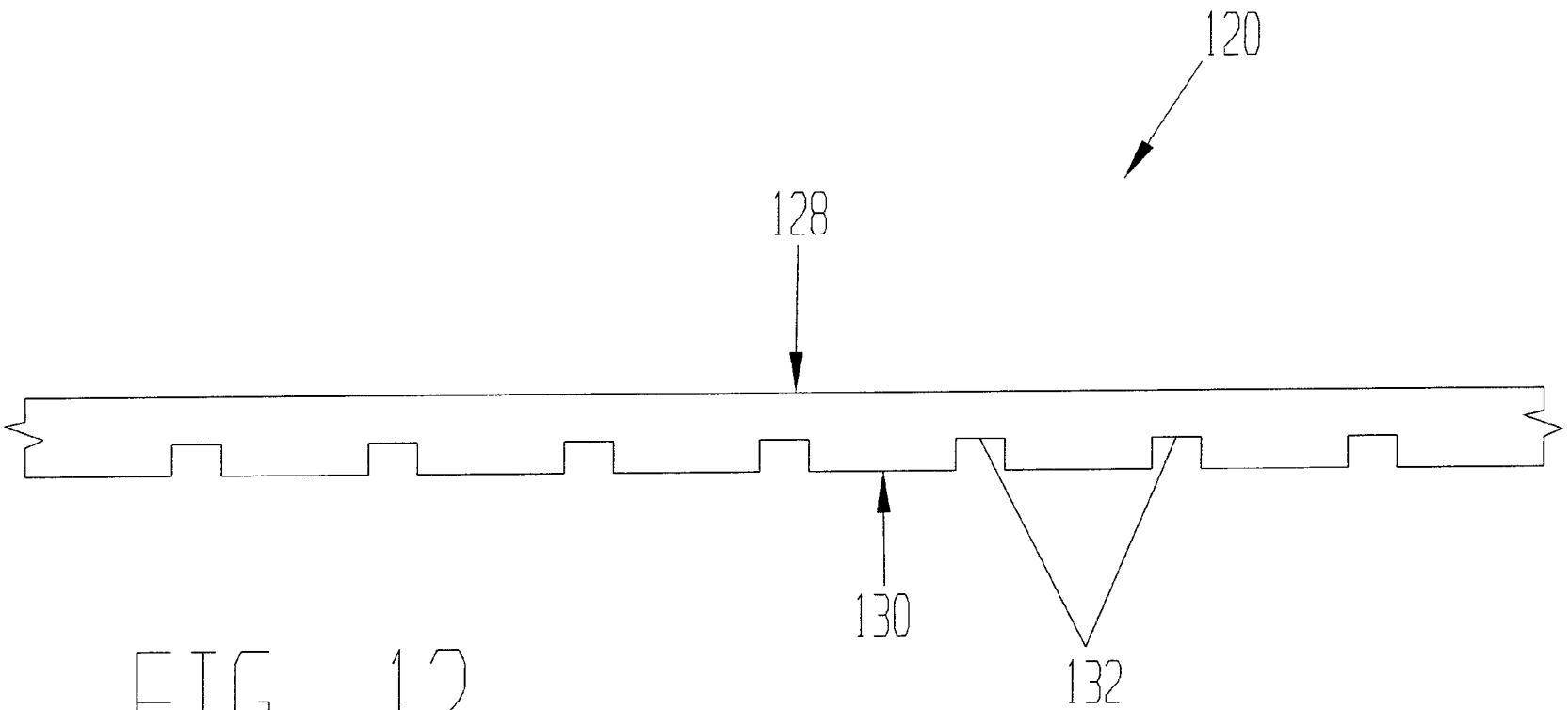
FIG. 12 is a fragmented side view of a unitary belt used with any of the first, second and third embodiments.

Referring now to FIG. 12, it can be seen that belt 120 is substantially flat and has an outer side 128 and an opposite inner side 130. Inner side 130 is provided with a plurality of longitudinally spaced and laterally extending grooves 132 which define ribs on the inner side 130 of the belt, thereby facilitating the belt's ability to wrap itself about the pulleys and the spool. Belt 120 can be any of a number of commercially available belts of suitable width, length and material properties that may be selected based on the requirements of the application for which lift assembly 20 is to be used.

Referring to FIG. 5, elongate unitary belt 120 extends from about spool 116 rightwardly to first pulley arrangement 58 where it is wrapped about pulley 62*a*, and from pulley 62*a* belt 120 reverses course and at a slight return angle returns toward second pulley arrangement 88 where it is then wrapped about pulley 92*a*. From pulley 92*a* belt 120 reverses course and at a slight return angle returns toward first pulley arrangement 58 where it is wrapped about pulley 62*b*. From pulley 62*b* belt 120 reverses course and at a slight return angle returns toward second pulley arrangement 88 where it is wrapped about pulley 92*b*. From pulley 92*b* belt 120 reverses course and at a slight return angle returns toward first pulley arrangement 58 where it is wrapped about pulley 62*c*. From pulley 62*c* belt 120 reverses course and at a slight return angle returns toward second pulley arrangement 88 where it is wrapped about pulley 92*c*. From pulley 92*c* belt 120 reverses course and at a slight return angle returns toward first pulley arrangement 58 where it is wrapped about pulley 62*d*. From pulley 62*d* belt 120 reverses course and at a slight return angle returns toward second pulley arrangement 88 where it is wrapped about pulley 92*d*. From pulley 92*d* belt 120 returns in a direction toward the first pulley arrangement 58 and wraps about pulley 62*e*, and reverses course returning toward second pulley arrangement 88 and its second end 122 is affixed to cross brace 82 of base 22. The return angle along which belt 120 extends between the first and second pulley arrangements 58, 88 is relative to their parallel pulley axes 76, 106, and will vary slightly as lift assembly 20 moves between its elevated state 26 in which the return angle is at a maximum, and its lowered state 28 in which the return angle is at a minimum. The belt's ability to accommodate the return angles is facilitated in part by the belt engaging circumferential pulley surface 330 of pulleys 62 and 92.

One of ordinary skill in the art will recognize that first pulley arrangement 58, which is attached by its blocks 66 and 68 to scissor arm assembly 30, is biased rightwardly as shown in FIG. 5 and away from second pulley arrangement 88 which is affixed to base 22, to maintain an amount of tension on belt 120. The first and second pulley arrangements 58, 88 are biased apart from each other under the weight of scissor arm assembly 30, platform 24, and any load on the platform. Thus, axes 76, 106 are biased laterally apart from each other in plane 126. Pulleys 92 and pulley 62 may be of a common diameter, and thus the lengths of belt 120 extending therebetween on opposite sides of plane 126 respectively lay in common planes parallel to plane 126.

As belt 120 is wound onto spool 116, the length of the path along which belt 120 is guided about pulley 62 and 92 becomes shortened, and axes 106 and 76 are moved laterally within plane 126 towards one another as the lower ends 44 of first arms 38 are moved leftwardly towards lower ends 44 of second arms 44, thereby changing the angle at which the elongate first and second arms 38, 40 are crossed, and platform 24 is moved upwardly towards its elevated state 26.

Conversely, as belt 120 is unwound from about spool 116, the weight of scissor arm assembly 30, platform 24, and any load it bears, urges scissor arm assembly 30 towards a collapsed state, in which the angle at which the elongate first and second scissor arms 38, 40 are crossed changes such that first pulley arrangement 58 is moved rightwardly away from second pulley arrangement 88, and lift assembly 20 is moved towards its lowered state 28.

Referring now to FIGS. 6-9, there is shown second embodiment scissor-type lift assembly 20A, which is similar in general configuration to first embodiment scissor lift assembly 20 except as otherwise described below.

Figure 6:
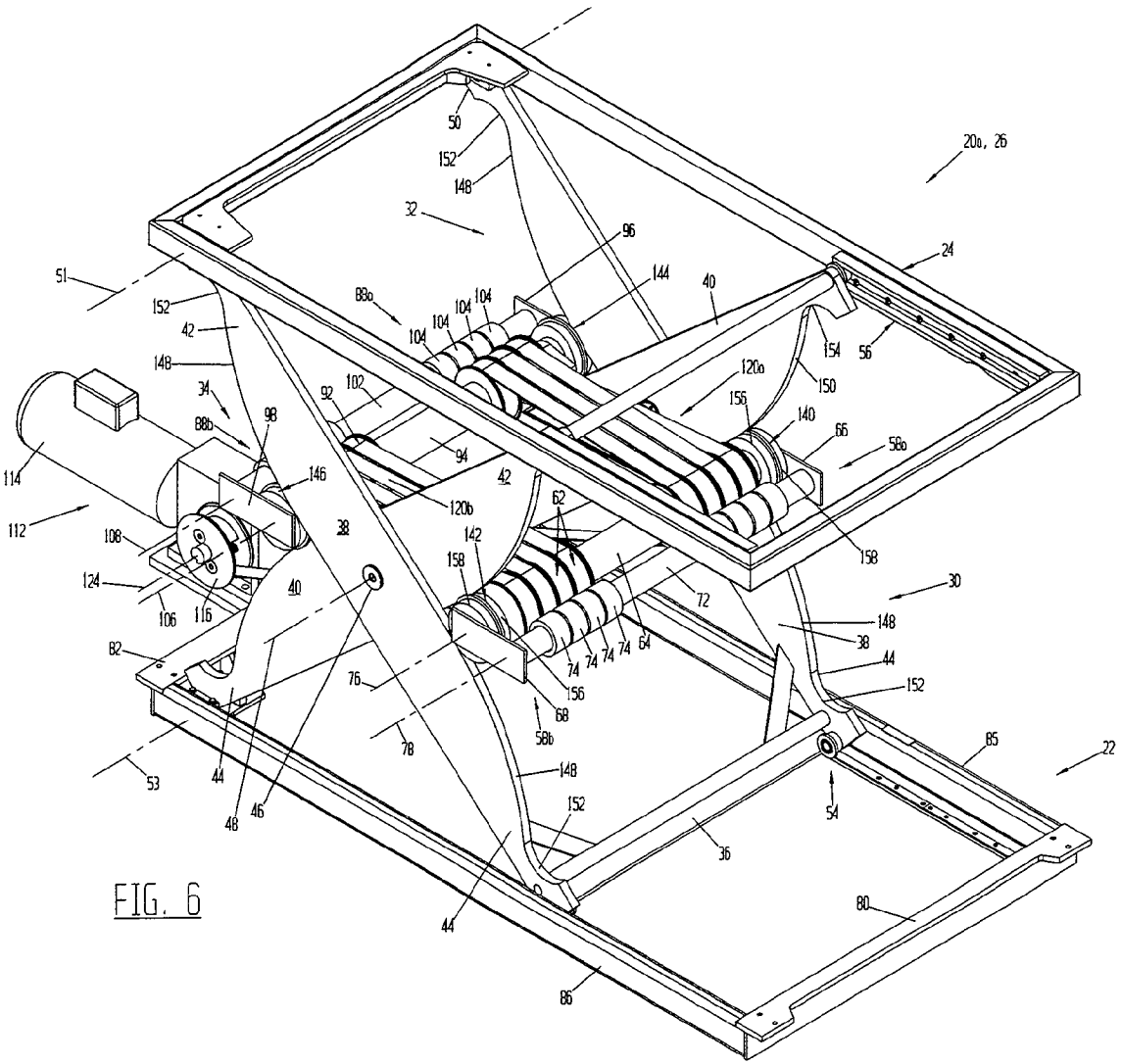
FIG. 6 is a perspective view of a scissor-type lift assembly according to a second embodiment in an elevated state.

Scissor lift assembly 20A includes a motor drive assembly 112 in which reversible servo or stepper motor 114 is oriented along a drive axis 134 that is substantially perpendicular to spool drive axis 124, the output shaft of motor 114 extending into a gear drive unit in which the spool driving output shaft that defines axis 124 extends laterally in opposite directions from the gear drive housing. Each laterally extending end of the output shaft has a spool 116 affixed thereto. As best shown in FIG. 6, lift assembly 20A includes a pair of first and second drive belts 120*a*, 120*b* which work in parallel and provides a measure of safety beyond the single belt arrangement shown in first embodiment lift assembly 20. The depicted dual-belt configuration of lift assembly 20A protects the user and the lifted load from injury or damage due to failure of one of the drive belts 120*a* and 120*b*. It is to be understood that first embodiment lift assembly 20 may be outfitted with a dual belt drive like that shown in second embodiment scissor lift assembly 20A. Conversely, second embodiment scissor lift assembly 20A may be outfitted with a single belt drive like that shown in first embodiment lift assembly 20.

Figure 7:
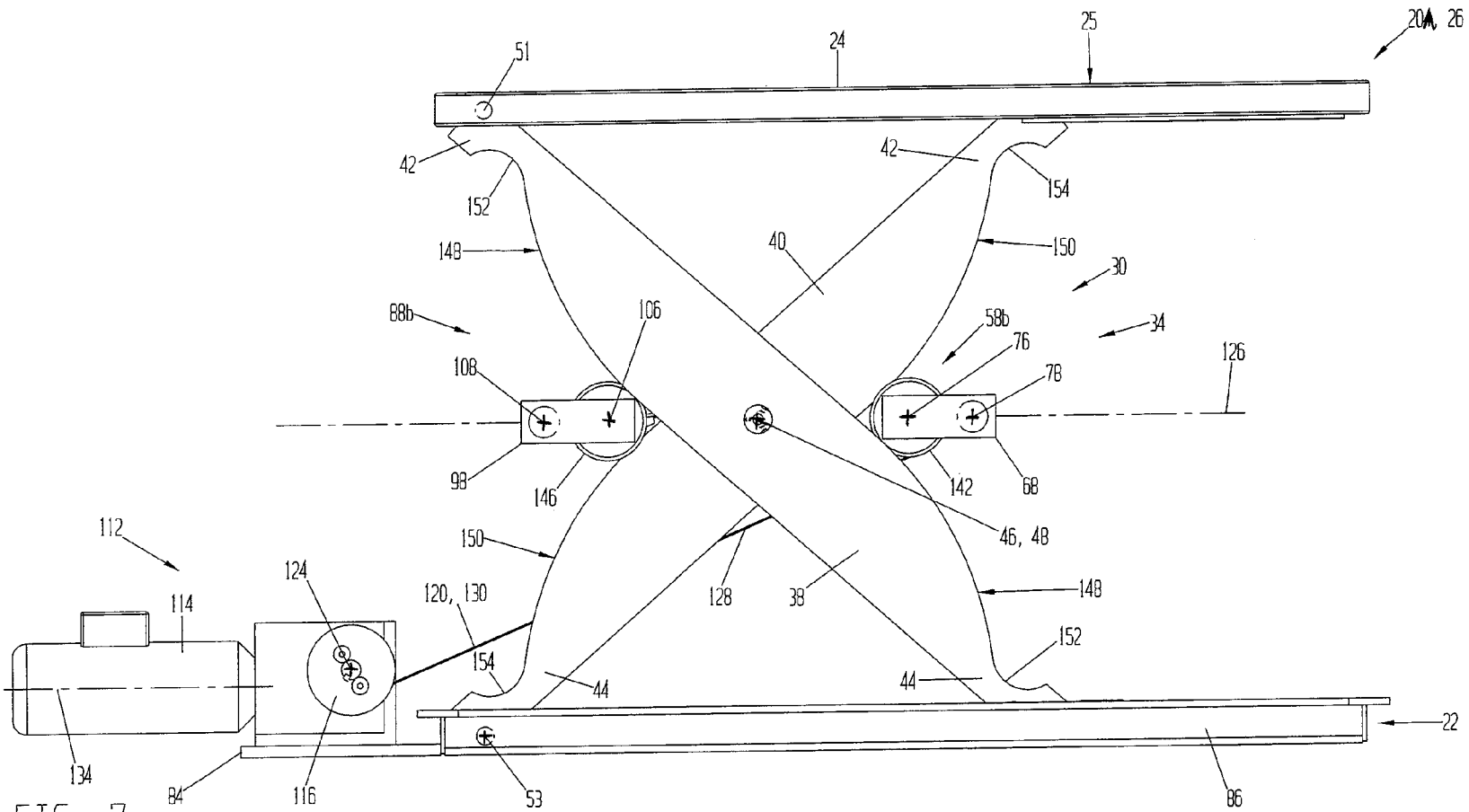
FIG. 7 is a side view of the lift assembly shown in FIG. 6 in an elevated state.

In second embodiment scissor lift assembly 20A, the first and second pulley arrangements 58, 88 are disposed between the first and second scissor arms 38, 40 of the first and second pairs of scissor arms 32, 34. First pulley arrangement 58 includes a pulley arrangement 58*a* associated with first drive belt 120*a* and another pulley arrangement 58*b* associated with second drive belt 120*b*. The pulleys 62 of each first pulley arrangement 58*a* and 58*b* are independently rotatably disposed on a common shaft 64 extending between and fixed to laterally spaced blocks or support members 66 and 68. Shaft 64 defines axis 76 about which pulleys 62 rotate. At each of the opposite ends of shaft 64, between the laterally outermost pulleys 62 and the adjacent block 66, 68, there is provided a cam follower or roller rotatable about axis 96. Cam followers 140 and 142 respectively engage the rightwardly-facing edges of the first and second pairs of scissor arms 32 and 34, as shown in FIGS. 6 and 7. Each cam follower 140, 142 includes two adjacent, relatively rotatable roller elements 156, 158.

Similarly, second pulley arrangement 88 includes a pulley arrangement 88*a* associated with first drive belt 120*a* and another pulley arrangement 88*b* associated with second drive belt 120*b*. The pulleys 92 of each second pulley arrangement 88*a* and 88*b* are independently rotatably disposed on a common shaft 94 extending between and fixed to laterally spaced blocks or support members 96 and 98. Shaft 94 defines axis 106 about which pulleys 92 rotate. At each of the opposite ends of shaft 94, between the laterally outermost pulleys 92 and the adjacent block 96, 98, there is provided a cam follower or roller rotatable about axis 106. Cam followers 144 and 146 respectively engage the leftwardly-facing edges of the first and second pairs of scissor arms 32 and 34, as shown in FIGS. 6 and 7. Like cam followers 140, 142, each cam follower 144, 146 includes two adjacent, relatively rotatable roller elements 156, 158.

In each of cam followers 140, 142, 144, 146, roller element 156 is located laterally inboard of roller element 158 and is in rolling contact with an edge of a second scissor arm 40, and laterally outboard roller element 158 is in rolling contact with an edge of a first scissor arm 38. Thus, the roller elements 156, 158 of each cam follower 140, 142, 144, 146 rotate in opposite directions as they roll along their respective scissor arm edges.

Each inboard roller element 156 of a cam follower 140, 142, 144, 146 engages a cam surface 150 defined on an edge of a second scissor arm 40 of the first and second pairs of scissor arms 32, 34. Similarly, each outboard roller element 158 of a cam follower 140, 142, 144, 146 engages a cam surface 148 defined on an edge of a first scissor arm 38 of the first and second pairs of scissor arms 32, 34.

Figure 9:
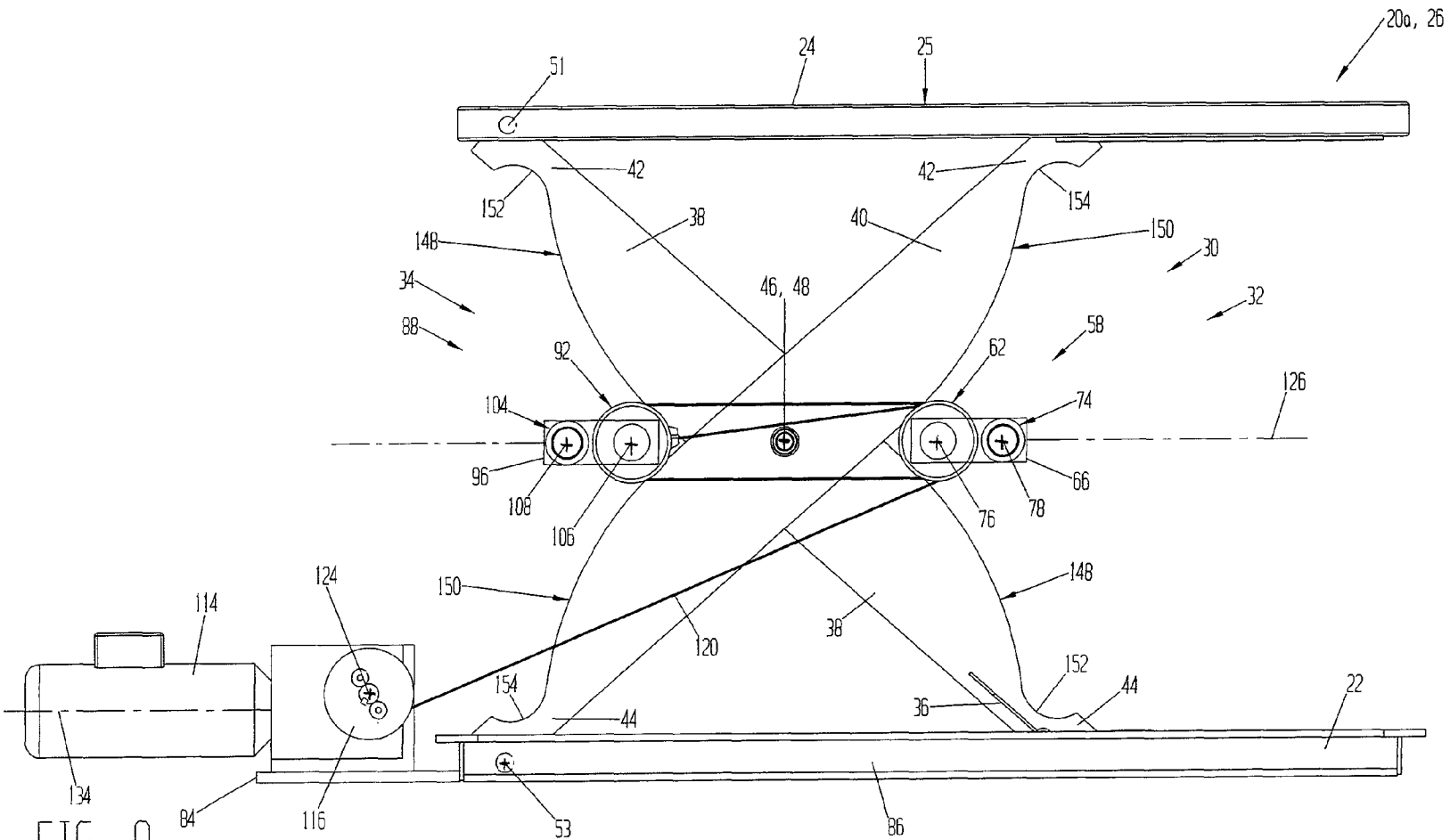
FIG. 9 is a side view of the lift assembly shown in FIG. 6 in an elevated state, with the second pair of scissor arms removed from view.

As perhaps best shown in FIG. 9, axes of rotation 76 and 106 of the first and second pulley arrangements 58, 88 lie in a plane 126, the orientation of which is maintained throughout movement of the lift assembly 20A between its elevated and lowered states. In lift assembly 20A, plane 126 remains substantially horizontal, and also includes pivot axis 48. Here, as opposed to first embodiment lift assembly 20, plane 126 is not fixed relative to base 22, but rather moves vertically up and down with movement of lift assembly 20A between its elevated and lowered states 26, 28.

The tension on belts 120*a* and 120*b* maintain cam followers 140, 142 and 144, 146 of the first and second pulley arrangements 58 and 88 in engagement with surfaces 150 and 148 of first and second arms 38 and 40 of the first and second pairs of scissor arms 32, 34. Cam surfaces 148, 150 are designed to easily facilitate an initial movement of lift assembly 20A from its lowered state 28 to minimize additional loading on motor 114 than would otherwise be required in the absence of the cam surfaces being so designed. As shown, the cam surfaces 148, 150 establish, in the lowered state 28, a gradual slope along which roller elements 56, 58 are forced to roll in response to belts 120*a*, 120*b* being wound onto their respective spools 116. The slope increases somewhat as lift assembly 20A is moved out of its lowered state 28 and axes 96, 106 are pulled laterally toward each other in plane 126. Once the lift assembly 20A has been moved from its initial, lowered state 28, the cam surfaces 148, 150 engaged by followers 140, 142, 144, 146 change their slopes such that the load on motor 114 is maintained at an approximately constant level, and an increased rate of change in height of platform 24 results.

Figure 13:
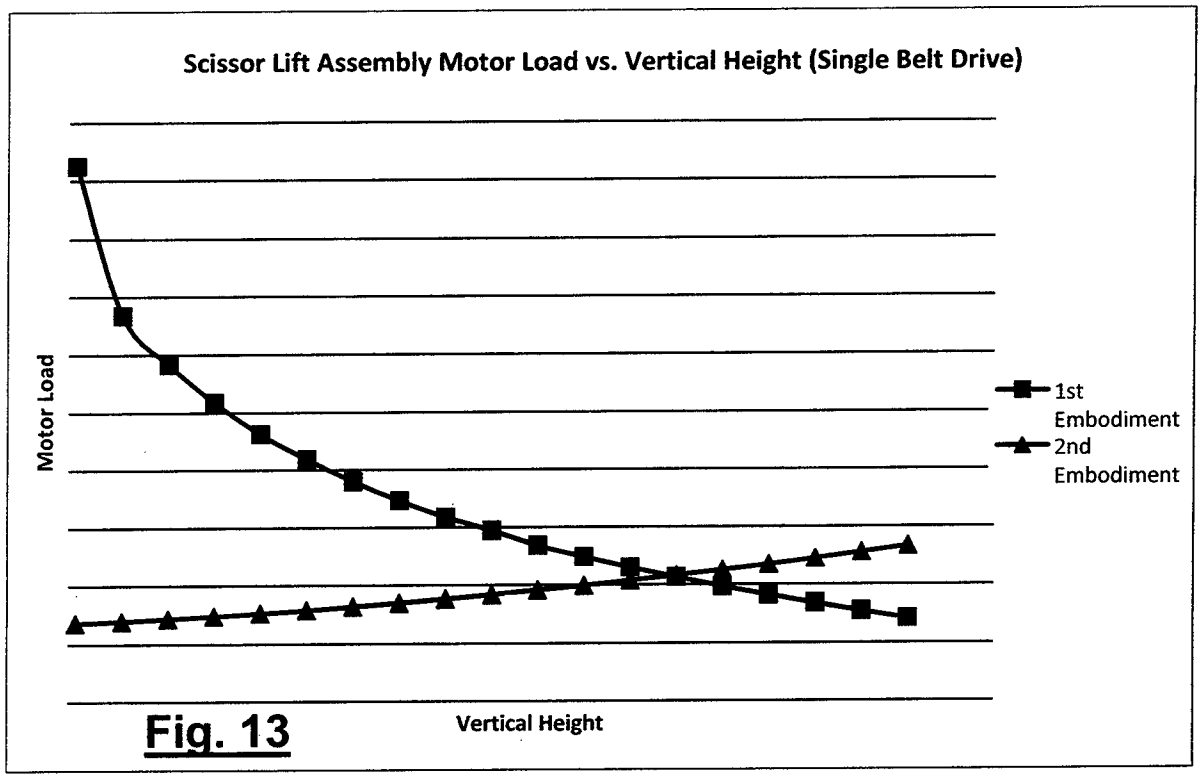
FIG. 13 is a fragmented, partially sectioned view of an exemplary pulley, retainer roller and unitary belt of any of the first, second and third embodiments.

FIG. 13 provides a qualitative comparison between a first embodiment scissor lift assembly (e.g., lift assembly 20) and an comparably sized second embodiment scissor lift assembly (e.g., lift assembly 20A), the latter having cam surfaces 148, 150 substantially configured as shown in FIGS. 6-9 and described above. The first and second embodiment scissor lift assemblies compared through the plotted curves of FIG. 13 each have a single belt drive, as described above, and a common number of first and second pulleys 62, 92 in their respective first and second pulley arrangements 58, 88. Additionally, the comparison is through a range between lowered and elevated states that are respectively established at common platform heights, and the loads borne by their respective platforms are identical.

The motor load is derived as a function of the tension force in the segment of belt 120 extending from about spool 116. FIG. 13 shows, in raising the platform from the lift assembly lowered or contracted state 28 (at the left side of the graph) to the lift assembly elevated or extended state 26 (at the right side of the graph) the second embodiment scissor lift substantially reduces the motor loading vis-à-vis the first embodiment lift assembly up to a height substantially past the midpoint of platform travel, where the two lines intersect. After this height is reached, the motor load of the second embodiment lift assembly is comparatively higher, but not substantially so. Indeed, the second embodiment lift assembly motor load has only gradual, substantially linear increases as it moves from the lowered to the elevated state. On the other hand, the first embodiment lift assembly shows a dramatic initial reduction in motor loading immediately after moving from its lowered state, with further, more gradual and substantially linear motor load reduction occurring in the latter portions of upward platform travel towards the elevated state.

Clearly, it would be desirable to avoid the initial, comparatively much higher motor loading in moving from the lift assembly lowered state as the second embodiment lift assembly allows, for the substantially greater initial loading comes with attendant increases in energy use and stresses on the belt and other lift assembly components. However, it is contemplated that a second embodiment scissor lift assembly will likely have greater cost than a comparable first embodiment scissor lift assembly. On the other hand, the relatively flatter motor load curve of the second embodiment scissor lift assembly will likely reduce the need for an expensive motor control system.

Those of ordinary skill in the art will recognize that, in either of the first and second embodiment scissor lift assemblies, motor loading can be reduced by correspondingly increasing the number of first and second pulleys 62, 92 of the first and second pulley arrangements 58, 88 over which belt 120 is wrapped, with belt 120 being correspondingly lengthened to accommodate its increased path. This reduction in motor loading/belt tension would, however, result in comparatively slower travel between the lift assembly contracted and elevated states.

Figure 8:
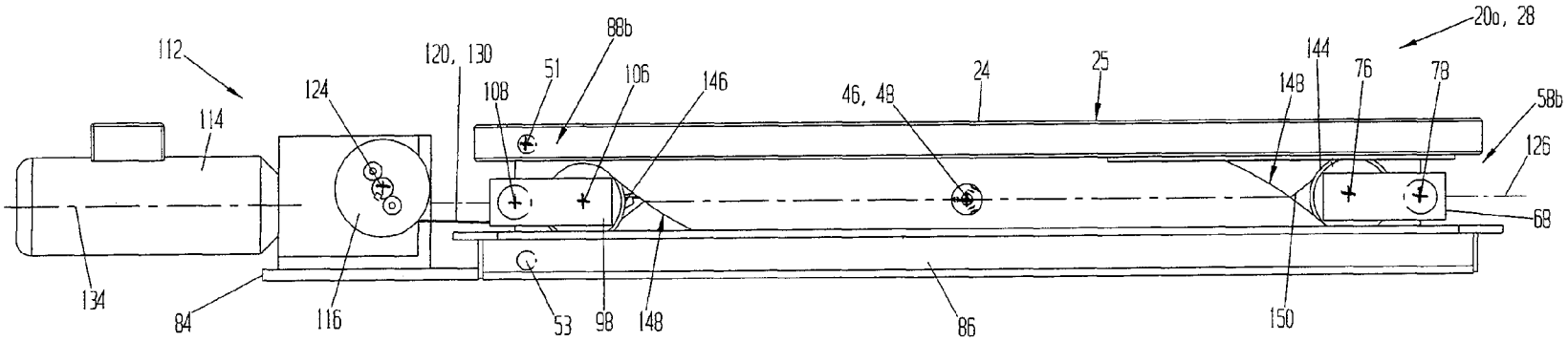
FIG. 8 is a side view of the lift assembly shown in FIG. 6 in a lowered state.

Returning to FIGS. 6-9, the cam surfaces 148 of second embodiment scissor lift assembly 20A are each contoured near opposite ends 42, 44 of the first arms 38 to define recesses 152. Similarly, cam surfaces 150 are each contoured near opposite ends 42, 44 of the second arms 40 to define recesses 154. In the lowered state 28 of lift assembly 20A, as shown in FIG. 8, the cam followers 140, 142, 144, 146 are received in spaces defined by recesses 152 and 154 to minimize the total height of lift assembly 20A between the bottom most part of its base 22 and load supporting surfaces 25 of platform 24 in lowered state 28.

First and second pulley arrangements 58 and 88 of second embodiment lift assembly 20A respectively further include shafts 72, 102, that are fixed to and extend in parallel with shafts 64, 94 between laterally spaced blocks or support members 66, 68 and 96, 98. Blocks 66, 68, 96, 98 are preferably structured and interconnected to maintain a consistent orientation of axes 78 and 108 relative to plane 126. They may, for example, both lie in plane 126 as shown. Between the first and second pulley arrangements 58, 88, a pair of blocks (e.g. 66 and 96, or 68 and 98) may be linked together laterally outside the adjacent pair of scissor arms 32 or 34, for example.

Figure 10:
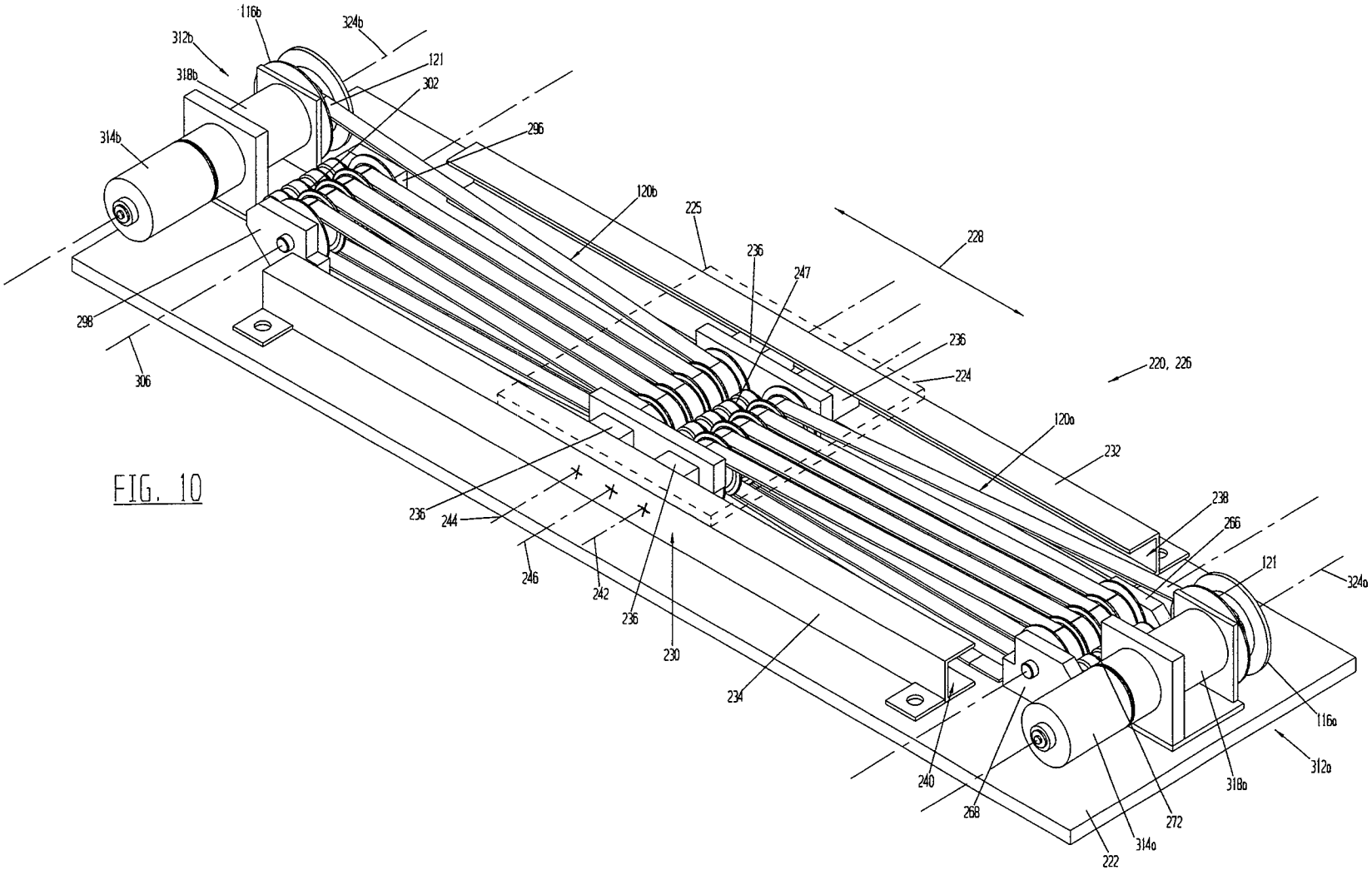
FIG. 10 is a perspective view of a conveyor or lift assembly according to a third embodiment, with its platform shown in phantom lines.
Figure 11:
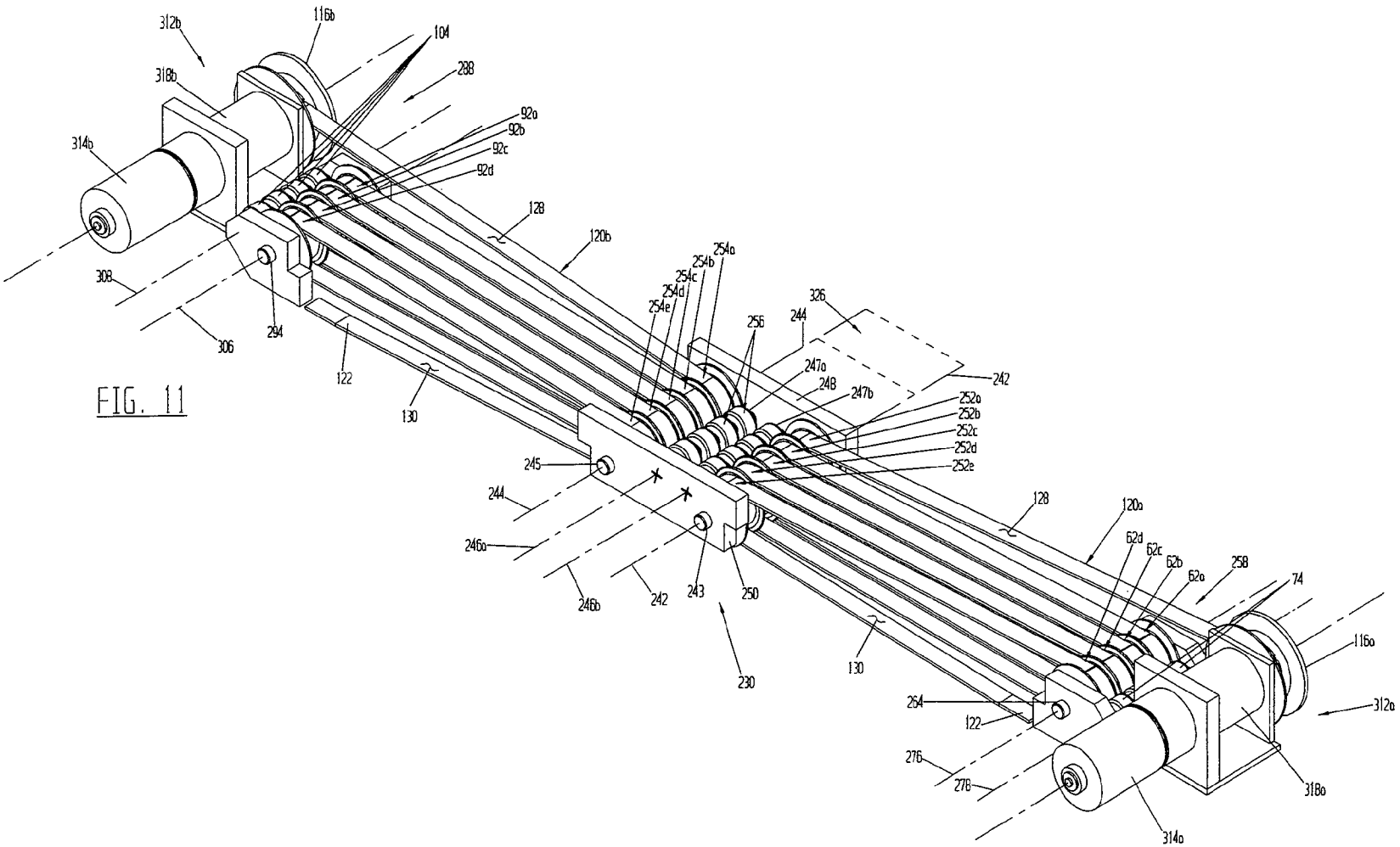
FIG. 11 is a perspective view of a variant of the conveyor or lift assembly shown in FIG. 10 with its platform, base and guide structure removed from view.

Referring now to FIGS. 10 and 11 there is shown a conveyor or lift assembly 220, a third embodiment of the present invention. Assembly 220 includes base 222, and as a conveyor assembly may also include platform 224 (shown in phantom lines in FIG. 10) defining support surface 225. Conveyor or lift assembly 220 has a centered state 226 and is arranged to provide conveying or lifting movement longitudinally in the directions indicated by double-headed arrow 228. A load supported by carriage 230 is thus moved longitudinally through operation of assembly 220. The load may be supported by platform 224 and moved substantially horizontally as a conveyor or, alternatively, a load supported by carriage 230 may be moved substantially vertically, as a lift or elevator.

Carriage 230, to which platform 224 may be attached, is disposed between a pair of longitudinally extending rails 232 and 234. Carriage 230 is provided with bearing elements 236 that are received in and supported by guide tracks 238, 240 of rails 232, 234. Bearing elements 236 support the load placed on surface 225 of platform 224 when assembly 220 is in a substantially horizontal orientation, or otherwise constrain the movement of carriage 230 away from base 222. Base 222, platform 224, and rails 232, 234 may be made of steel.

In FIGS. 10 and 11, the longitudinal direction is that indicated by arrow 228, the lateral direction being substantially perpendicular thereto in the directions of carriage pulley axis 242 defined by shaft 243, carriage pulley axis 244 defined by shaft 245, and carriage retainer roller axis 246 defined by shaft 247. Shafts 243, 245, and 247 extend between and are fixed to a pair of laterally spaced blocks 248, 250 to which bearings 236 are attached at the laterally outward sides thereof. Referring to FIG. 11, a variation of assembly 220 is shown that includes a pair of retainer roller axes 246*a* and 246*b* associated with a pair of shafts 247*a* and 247*b* extending between and fixed to blocks 248, 250, instead of the single shaft 247 and axis 246 shown in FIG. 10. Platform 224 may be attached to blocks 248, 250.

Respectively disposed about shafts 243 and 245 are like-numbered pluralities of independently rotatable carriage pulleys 252 and 254 which may be identical to above-discussed pulleys 62, 92. Disposed about shaft 247 (or about shafts 247*a* and 247*b*) are a plurality of retention rollers 256 which may be identical to above-discussed retention rollers 74, 104. In FIG. 10, where a single shaft 247 carries retention rollers 256, there are a like number of retention rollers 256 and pairs of carriage pulleys 252 and 254, each retention roller disposed between and having a common relationship with each pair of carriage pulleys. In the variation shown in FIG. 11, there is a retention roller 256 associated with each one of carriage pulley 252, 254. The relationship between each pulley and its retention roller is as discussed above.

Assembly 220 further includes first pulley arrangement 258, shown on the right side of FIGS. 10 and 11. First pulley arrangement 258 includes shaft 264 defining axis 276 about which is disposed a plurality of independently rotatable pulleys 62. Shaft 264 extends between and is fixed to a laterally spaced pair of blocks 266, 268 which are affixed to base 222. First pulley arrangement 258 further includes shaft 272 defining axis 278. Shaft 272 extends between and is fixed to blocks 266, 268, and is parallel to shaft 264. Disposed about shaft 272 is a plurality of independently rotatable retention rollers 74, one for each pulley 62.

Referring to the left side of FIGS. 10 and 11, assembly 220 further includes a second pulley arrangement 288 which is similar in configuration to first embodiment pulley assembly 258. Second pulley arrangement 288 includes shaft 294 defining axis 306 about which is disposed a plurality of independently rotatable pulleys 92, with shaft 294 extending between and fixed to laterally spaced blocks 296, 298 which are affixed to base 222. Second pulley arrangement 288 further includes shaft 302 defining axis 308. Shaft 302 extends between and is fixed to blocks 296, 298, and is parallel to shaft 294. Disposed about shaft 302 is a plurality of independently rotatable retention rollers 104, one for each pulley 92. Blocks 248, 250, 266, 266, 296, and 298 may be made of steel.

Extending between first pulley arrangement 258 and carriage 230 is first drive belt 120*a*, which is guided over a path defined by pulleys 62 and 252. As shown, there are four pulleys 62 in first pulley arrangement 258, identified as 62*a-d*, and five carriage pulleys 252, identified as carriage pulleys 252*a-e*. Elongate unitary belt 120*a* extends from about spool 116*a* leftwardly to carriage 230 where it is wrapped about carriage pulley 252*a*, and from pulley 252*a* belt 120*a* reverses course and at a slight return angle returns toward first pulley arrangement 258 where it is then wrapped about pulley 62*a*. From pulley 62*a* belt 120*a* reverses course and at a slight return angle returns toward carriage 230 where it is wrapped about pulley 252*b*. From pulley 252*b* belt 120*a* reverses course and at a slight return angle returns toward first pulley arrangement 258 where it is wrapped about pulley 62*b*. From pulley 62*b* belt 120*a* reverses course and at a slight return angle returns toward carriage 230 where it is wrapped about pulley 252*c*. From pulley 252*c* belt 120*a* reverses course and at a slight return angle returns toward first pulley arrangement 258 where it is wrapped about pulley 62*c*. From pulley 62*c* belt 120*a* reverses course and at a slight return angle returns toward carriage 230 where it is wrapped about pulley 252*d*. From pulley 252*d* belt 120*a* reverses course and at a slight return angle returns toward first pulley arrangement 258 where it is wrapped about pulley 62*d*. From pulley 62*d* belt 120*a* returns in a direction toward carriage 230 and wraps about pulley 252*e*, and reverses course returning toward first pulley arrangement 258 and its second end 122 is affixed to base 222. The return angle along which belt 120*a* extends between the carriage 230 and the first pulley arrangement 258 is relative to their parallel pulley axes 242, 276 and will vary slightly as carriage 230 moves longitudinally in the directions indicated by arrow 228, the return angle being at a maximum when carriage 230 is rightmost and being at a minimum when carriage 230 is leftmost, as viewed in FIGS. 10 and 11. The belt's ability to accommodate the return angles is facilitated in part by the belt engaging circumferential pulley surface 330 of pulleys 62 and 252.

Extending between second pulley arrangement 288 and carriage 230 is second drive belt 120*b*, which is guided over a path defined by pulleys 92 and 254. As shown, there are four pulleys 92 in second pulley arrangement 288, identified as 92*a-d*, and five carriage pulleys 254, identified as carriage pulleys 254*a-e*. Elongate unitary belt 120*b* extends from about spool 116*b* rightwardly to carriage 230 where it is wrapped about carriage pulley 254*a*, and from pulley 254*a* belt 120*b* reverses course and at a slight return angle returns toward second pulley arrangement 288 where it is then wrapped about pulley 92*a*. From pulley 92*a* belt 120*b* reverses course and at a slight return angle returns toward carriage 230 where it is wrapped about pulley 254*b*. From pulley 254*b* belt 120*b* reverses course and at a slight return angle returns toward second pulley arrangement 288 where it is wrapped about pulley 92*b*. From pulley 92*b* belt 120*b* reverses course and at a slight return angle returns toward carriage 230 where it is wrapped about pulley 254*c*. From pulley 254*c* belt 120*b* reverses course and at a slight return angle returns toward second pulley arrangement 288 where it is wrapped about pulley 92*c*. From pulley 92*c* belt 120*b* reverses course and at a slight return angle returns toward carriage 230 where it is wrapped about pulley 254*d*. From pulley 254*d* belt 120*b* reverses course and at a slight return angle returns toward second pulley arrangement 288 where it is wrapped about pulley 92*d*. From pulley 92*d* belt 120*b* returns in a direction toward carriage 230 and wraps about pulley 254*e*, and reverses course returning toward second pulley arrangement 288 and its second end 122 is affixed to base 222. The return angle along which belt 120*b* extends between the carriage 230 and the second pulley arrangement 288 is relative to their parallel pulley axes 244, 306 and will vary slightly as carriage 230 moves longitudinally in the directions indicated by arrow 228, the return angle being at a maximum when carriage 230 is leftmost and being at a minimum when carriage 230 is rightmost, as viewed in FIGS. 10 and 11. The belt's ability to accommodate the return angles is facilitated in part by the belt engaging circumferential pulley surface 330 of pulleys 92 and 254.

As described above, first end 121 of each belt 120 is attached to its respective spool 116 and is wound onto or unwound from the spool 116, which changes the length of the path over which the belt 120 extends, the path being defined by the respective pulleys over which it is wrapped. The second end 122 of each belt 120 is affixed to base 222 adjacent the respective first or second pulley arrangement.

Assembly 220 includes a first motor drive assembly 312*a* which is arranged for pulling belt 120*a* rightward through rotation of its motor 314*a* which may be rotatable in only a single direction. As shown, the direction of rotation of motor 314*a* of motor drive assembly 312*a* when pulling carriage 230 rightwardly as belt 120*a* is wound onto spool 116*a*, is clockwise. In motor drive assembly 312*a*, the output shaft of motor 314*a* may extend through a clutch housing 318*a* that includes a one way clutch which allows belt 120*a* to be unwound from spool 116*a* as carriage 230 is pulled leftwardly by second motor drive assembly 312*b* when motor 314*a* is de-energized.

Similarly, second motor drive 312*b* of assembly 220 is arranged for pulling belt 120*b* leftwardly through rotation of its motor 314*b* which may be rotatable in only a single direction. As shown, the direction of rotation of motor 314*b* of motor drive assembly 312*b* when pulling carriage 230 leftwardly as belt 120*b* is wound onto spool 116*b*, is counterclockwise. In motor drive assembly 312*b*, the output shaft of motor 314*b* may extend through a clutch housing 318*b* that includes a one way clutch which allows belt 120*b* to be unwound from spool 116*b* as carriage 230 is pulled rightwardly by first motor drive assembly 312*a* when motor 314*b* is de-energized.

One of ordinary skill in the art will recognize that motor drive assemblies 312*a* and 312*b* are individually and exclusively energized to move a load supported by carriage 230 in one of the two directions indicated by arrow 228. Movement of carriage 230 rightward as shown in FIGS. 10 and 11, for example, involves energizing motor drive assembly 312*a* which will wind belt 120*a* onto spool 116*a*, shortening the path over which it extends over pulleys 62 and 252, thus moving axis 242 towards axis 276. Axes 242 and 276 can, of course, define a plane in which the axes can move laterally toward and away from each other. As carriage 230 is moved leftward as belt 120*b* is wound onto spool 116*b*, belt 120*a* is unwound from about spool 116*a* of motor drive assembly 312*a* as the clutch in clutch housing 318*a* allows relative rotation between spool 116*a* and motor 314*a*, thereby lengthening the path over which belt 120*a* extends over pulleys 62 and 252.

The relationship between each pulley 62, 92, 252, or 254 and its associated retention roller 74, 104, or 256 is now discussed. There is a gap between the circumferential surface 330 of the pulley and the circumferential surface 332 of the retention roller through which belt 120 is fed. The retention roller prevents the belt 120 from becoming disengaged from the pulley during installation and operation of the lift or conveyor assembly 20, 20A, 220. Notably, the proximity of the circumferential surfaces 330, 332 of the pulley and retention roller is such that the gap therebetween is sufficient to allow a space between the outer surface 128 of belt 120 and the surface 332 of the retention roller. Preferably, the retention roller extends partially between the opposed flanges 70, 100 of the pulley, thereby capturing the belt between the flanges. Further, as readily understood from the above description, the reversing path of a belt 120 over a series of any three pulleys causes the belt to be directed at different return angles on the top and bottom sides of the pulleys. To accommodate this angling of the belt, the circumferential surface 330 of the pulley can be crowned.

As to a further discussion of the manner of usage and operation of the present invention, the same should be apparent from the above description. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A scissors-type lift assembly comprising:

a base;

a platform, said lift assembly having elevated and lowered states in which said platform and said base are distant and proximate, respectively;

a pair of first and second scissor arms each having upper and lower ends respectively coupled to said platform and said base, said pair of scissor arms pivotably connected to each other intermediate their respective upper and lower ends about a central pivot axis;

a first pulley arrangement comprising at least one first pulley disposed about a first pulley axis;

a second pulley arrangement comprising at least one second pulley disposed about a second pulley axis, said first and second pulley axes disposed in a pulley plane and having lateral movement relative to each other as said lift assembly is moved between its said elevated and lowered states, said pulley plane fixed relative to said base;

a spool rotatable about an axis fixed to said base; and a unitary belt guided through a path defined only by said first and second pulleys and said spool, said belt having opposed first and second ends, said belt first end engaged with said spool onto which said belt is wound and from which said belt is unwound;

said first and second pulley axes having a first lateral distance therebetween in said lift assembly elevated state and a second lateral distance therebetween greater than said first distance in said lift assembly lowered state, said first and second pulley axes pulled laterally together by said belt as it is wound onto said spool.

2. The scissors-type lift assembly of claim 1, wherein said pulley axes are biased laterally apart.

3. The scissors-type lift assembly of claim 1, wherein one of said first and second pulley axes is fixed relative to one of said first and second scissor arms.

4. The scissors-type lift assembly of claim 3, wherein the other of said first and second pulley axes is fixed relative to said base.

5. The scissors-type lift assembly of claim 4, wherein the other of said first and second scissor arms is pivotably attached to said base.

6. The scissors-type lift assembly of claim 1, further comprising a plurality of retention rollers, each of said retention rollers having a circumferential face disposed adjacent said belt with a positioning of said belt substantially along said path being maintained by said retention roller.

7. The scissors-type lift assembly of claim 6, wherein said plurality of retention rollers are disposed about a roller axis parallel with one of said first and second pulley axes.

8. A scissors-type lift assembly comprising:

a base;

a platform, said lift assembly having extended and contracted states, said platform at a relatively greater distance from said base in said extended state than in said contracted state;

a pair of first and second elongate arms each having opposite ends and extending between said base and said platform, said first and second arms pivotably connected together and crossing each other substantially at a first angle in said extended state and substantially at a second angle in said contracted state;

a first pulley arrangement comprising at least one first pulley rotatably disposed about a first pulley axis;

a second pulley arrangement comprising at least one second pulley rotatably disposed about a second pulley axis, said first and second pulley axes defining a stationary plane in which said first and second pulley axes have relative lateral movement, one of said first and second pulley arrangements affixed to one of, said first and second elongate arms, said arms moved between said first and second angles with relative lateral movement of said pulley axes;

a spool rotatable about an axis of rotation fixed relative to said base;

a unitary belt guided through a path defined only by said first and second pulleys and said spool, said belt having opposed first and second ends, said belt first end engaged with said spool onto which said belt is wound and from which said belt is unwound, said first and second pulley axes moved laterally in opposite directions relative to each other as said belt is respectively wound onto and unwound from said spool.

9. The scissors-type lift assembly of claim 8, further comprising a plurality of retention rollers, each of said retention rollers having a circumferential face disposed adjacent said belt with a positioning of said belt substantially along said path being maintained by said retention roller.

10. The scissors-type lift assembly of claim 9, wherein said plurality retention disposed about a roller axis parallel with one of said first and second pulley axes.

11. A lift assembly comprising:

a base;

a platform;

a pair of first and second elongate scissor arms each having a first end coupled to said base, and a second end coupled to said platform, said first and second scissor arms pivotably connected to each other at a location between their respective first and second ends; and a belt and pulley apparatus comprising:

a unitary belt having opposite first and second ends, a belt spool rotatably attached to said base and having reversible rotation about a spool axis, said belt first end secured to said spool, said belt second end secured to said base, said belt respectively wound onto and unwound from said spool with reversing rotation of said spool, a first pulley arrangement comprising a plurality of first pulleys disposed about a first axis, and a second pulley arrangement comprising at least one second pulley disposed about a second axis fixed relative to said base, said first and second axes substantially parallel with each other and laterally movable relative to each other in a stationary plane, said first axis fixed to one of said first and second scissor arms, with said unitary belt guided through a path defined only by said first and second pulley arrangements and said belt spool.

12. The lift assembly of claim 11, wherein said first axis is located between the pivotal connection between said first and second arms and the first end of said one of said first and second scissor arms.

13. The lift assembly of claim 11, further comprising a plurality of retention roller's, each of said retention rollers having a circumferential face disposed adjacent said belt with a positioning of said belt substantially along said path being maintained by said retention roller.

14. The lift assembly of claim 13, wherein said plurality of retention rollers are disposed about a roller axis parallel with one of said first and second pulley axes.

15. A belt-driven transportation system comprising:

a plurality of first pulleys rotatably attached to a first member with each of said first pulleys defining a first belt engaging surface;

a pair of first flanges associated with each of said first pulleys disposed on opposite sides of said first belt engaging surface;

a plurality of second pulleys rotatably attached to a second member with each of said second pulleys defining a second belt engaging surface, said first and second members having relative movement to each other;

a pair of second flanges associated with each of said second pulleys disposed on opposite sides of said second belt engaging surface;

a unitary belt disposed about said first and second belt engaging surfaces and guided through a path defined by said first and second flanges, said path substantially lying in a stationary plane; and a plurality of retention rollers with one of said retention rollers disposed adjacent each of said first and second pulleys, said belt extending between said pulleys and said retention rollers with a positioning of said belt substantially on said path between said flanges being maintained by said plurality of retention rollers, said first and second members moving relative to each other with changes in a length of said path;

wherein one of said plurality of retention rollers are partially disposed between each of said pair of first and second flanges.

16. The belt-driven transportation system of claim 15, wherein said plurality of first pulleys is rotatable about a first axis fixed relative to said first member, and said plurality of second pulleys is rotatable about a second axis fixed relative to said second member, said stationary plane defined by said first and second axes.

17. The belt-driven transportation system of claim 16, wherein said plurality of retention rollers includes a first set of retention rollers rotatable about a third axis fixed relative to said first member and a second set of retention rollers rotatable about a fourth axis fixed relative to said second member.

* * * * *

UNITED STATES PATENT AND TRADEMARK OFFICE

CERTIFICATE OF CORRECTION

PATENT NO. : 8,662,477 B2
APPLICATION NO. : 12/639632
DATED : March 4, 2014
INVENTOR(S) : Bacon It is certified that error appears in the above-identified patent and that said Letters Patent is hereby corrected as shown below:

IN THE CLAIMS:

Column 14, line 31, please delete "plurality retention" before "disposed" and replace with -- plurality of retention rollers --

Column 14, line 64, please delete "roller's" before "each" and replace with -- rollers --

Signed and Sealed this
Tenth Day of June, 2014

Michelle K. Lee

Michelle K. Lee
*Deputy Director of the United States Patent and Trademark Office*